US006634338B1

(12) United States Patent
Yamakado et al.

(10) Patent No.: US 6,634,338 B1
(45) **Date of Patent: *Oct. 21, 2003**

(54) FUEL INJECTION APPARATUS, FUEL INJECTION METHOD AND INTERNAL COMBUSTION ENGINE

(75) Inventors: Makoto Yamakado, Tsuchiura (JP); Kiyoshi Amou, Chiyoda-machi (JP); Yoshio Okamoto, Minori-machi (JP); Yuzo Kadomukai, Ishioka (JP); Hiromasa Kubo, Yokohama (JP); Kenji Tabuchi, Hitachinaka (JP); Toshio Takahata, Atsugi (JP); Yoshiyuki Tanabe, Hitachinaka (JP); Yasunaga Hamada, Hitachinaka (JP)

(73) Assignees: Hitachi, Ltd., Tokyo (JP); Hitachi Car Engineering Co., Ltd., Hitachinaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 11 days.

(21) Appl. No.: 09/531,493

(22) Filed: Mar. 20, 2000

(30) Foreign Application Priority Data

Apr. 8, 1999 (JP) ..... 11-100972

(51) Int. Cl.[7] ..... F02D 41/20

(52) U.S. Cl. ..... 123/490; 251/129.1; 361/154

(58) Field of Search ..... 123/490; 361/153, 361/154; 251/129.09, 129.1; 239/533.4

(56) References Cited

U.S. PATENT DOCUMENTS

| | | | | | |
|---|---|---|---|---|---|
| 3,936,863 | A | * | 2/1976 | Olmstead | 257/539 |
| 4,154,198 | A | * | 5/1979 | Hoshi | 123/490 |
| 4,338,651 | A | * | 7/1982 | Henrich | 361/154 |
| RE34,591 | E | * | 4/1994 | Yoshida et al. | 239/553.4 |
| 6,120,005 | A | * | 9/2000 | Wright | 251/129.09 |

FOREIGN PATENT DOCUMENTS

| | | |
|---|---|---|
| JP | 8326620 | 12/1996 |

* cited by examiner

*Primary Examiner*—Andrew M. Dolinar
(74) *Attorney, Agent, or Firm*—Antonelli, Terry, Stout & Kraus, LLP

(57) ABSTRACT

An electromagnetic fuel injector is provided with a first coil having a large rate of change in time of magnetomotive force and a second coil having a smaller rate of change in time of magnetomotive force than the first coil. During a valve opening operation at the time of opening the valve, current is passed through at least the first coil, and then current of a smaller current value than in the opening operation is caused to flow so as to hold the valve open, using the first and second coils.

12 Claims, 8 Drawing Sheets

FIG. 1a
FIG. 1b
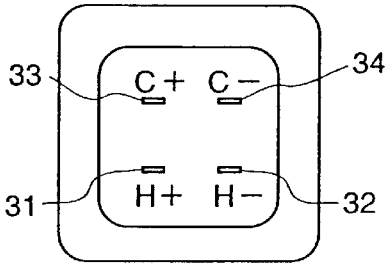
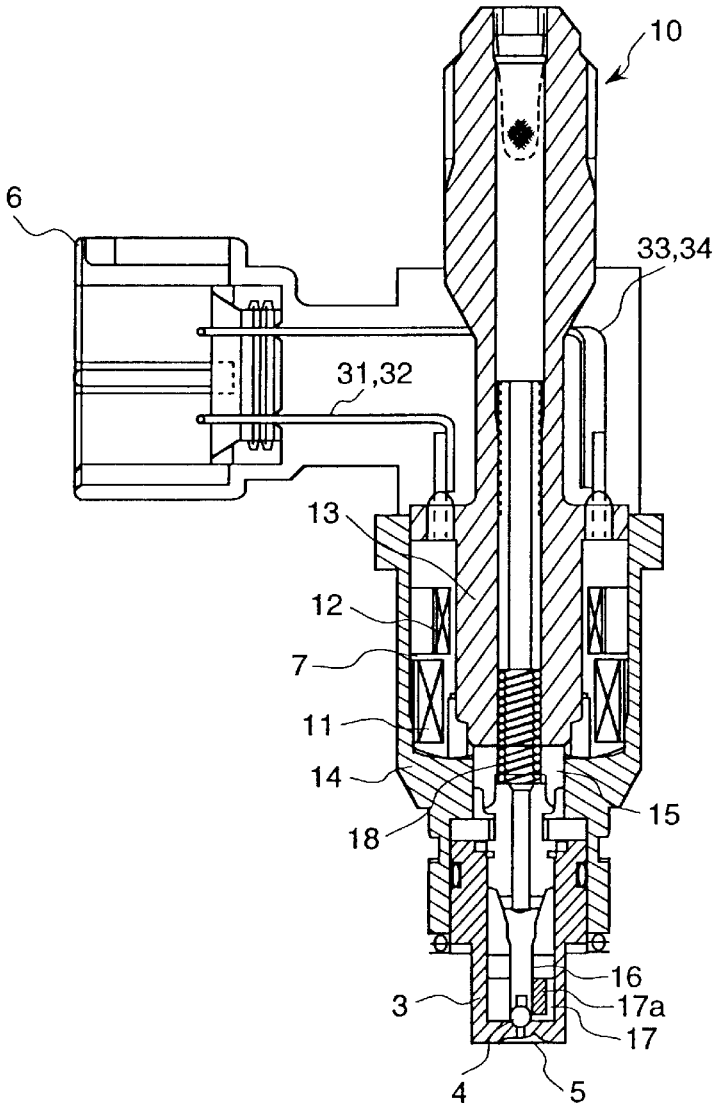

FUEL INJECTION APPARATUS, FUEL INJECTION METHOD AND INTERNAL COMBUSTION ENGINE

BACKGROUND OF THE INVENTION

The present invention relates to an electromagnetic fuel injector provided with a plurality of coils for driving a valve body and to a technique for driving the valve body.

An electromagnetic fuel injector has a structure to control the opening and closing of a fuel passage between a valve body and a valve seat by attracting a plunger with the electromagnetic (attraction) force generated by passing current through a coil inside the injector and selectively separating the valve body from the valve seat, thereby to inject fuel through a fuel injection orifice. Such an injector is provided with a return spring as means for urging the valve body in a direction to press it against the valve seat as the magnetic attracting force for the plunger attenuates when current passage to the coil is interrupted, so that the fuel passage between the valve body and the valve seat is closed, that is, the valve is closed.

JP A 8-326620 discloses an injector in which two coils, a coil A and a coil B are provided, electric current is passed through both the coils A and B for a certain period from the start of current flow during the valve opening operation, the current flowing into the coil A is stopped at the end of the certain period, and current is then passed through only the coil B.

SUMMARY OF THE INVENTION

In the injector disclosed in JP A 8-326620, the characteristics of the two coils, coil A and coil B are not sufficiently considered. When it is desired to secure a high speed response of the valve operation, it is difficult to obtain the magnetomotive force necessary for maintaining the valve open in an condition, and when it is intended to secure a good stability during the time of holding the valve open, there is the possibility that obtaining a high response speed of valve operation is not attainable, that is, a condition is reached where an improvement in the response of the attracting force reaches a limit.

The inventors have studied an electromagnetic fuel injector which has a first coil (control coil) with a large time change ratio of magnetomotive force, which is a product of the number of turns of the coil and the magnitude of the current passing through the coil, and a second coil (hold coil) with a smaller time change ratio of magnetomotive force than the first coil, wherein a battery voltage is applied so that magnetic flux is generated in both of the control coil and the hold coil with the same orientation at an initial stage of the valve opening operation. This results in application of a lot of magnetomotive force to open the valve. However, only the magnetomotive force necessary to hold the valve open is generated by applying the battery voltage to only the hold coil after the valve has opened, whereby it is possible to achieve a high injection ratio and wide dynamic range without increasing the system cost.

According to a demand for a higher injection ratio and a greater degree of atomization of the fuel spray, the operating fuel pressure of an injector has tended to become higher. That is, the force necessary for holding the valve body in an open position also increases. Under such a condition, it is necessary to pass a large current through the hold coil or to increase the magnetomotive force by increasing the number of turns of the coil. However, it is not desirable to cause a large current to flow because of the accompanying increase in heat generation. Particularly, when the injector is driven with a low voltage, such as a battery voltage, a large current is necessary. The quantity of heat generation (power) is given by a product of the battery voltage and coil-flowing current. For example, when the current is increased to be twice, the heat generation amount becomes twice and the temperature elevation also becomes twice. Further, when the number of turns of the hold coil is increased, the inductance increases at the second power of the number of turns. For example, when the number of turns is increased to twice, the inductance become four times. When the inductance increases, a time delay occurs at rise, fall of the current, whereby a high speed driving of the valve body, which enables extension of the dynamic range, becomes impossible.

Here, an object of the present invention is to make it possible to generate a driving force characteristic which is most desirable for operation of an injector.

In order to attain the above object, in accordance with the present invention, an electromagnetic fuel injector is provided with a first coil having a large time rate of change of magnetomotive force and a second coil having a smaller time rate of change of magnetomotive force than the first coil. During the operation, at the time of opening the valve, current is passed through at least the first coil, and then current having a smaller current value than in the opening operation is caused to flow so as to hold the valve open, using the first and second coils.

In this specification, the opening operation at the time of valve opening refers to the valve operation in which the valve body is opened fully from the condition where the valve body is in contact with the valve seat, and it is distinguished over the valve open holding condition after that, in which the valve is held open. Further, in some cases, the opening operation is emphatically referred to as an initial stage of the opening operation.

BRIEF DESCRIPTION OF THE DRAWINGS

FIG. 1*a* is a sectional view of an injector structure representing an embodiment of the present invention;

FIG. 1*b* is a plan view of a connector portion in FIG. 1*a;*

FIG. 2(*b*) is a plan view of the bobbin of FIG. 2(*a*);

DESCRIPTION OF EMBODIMENTS OF THE INVENTION

Hereunder, embodiments of the present invention will be described with reference to the drawings.

Figure 2A:
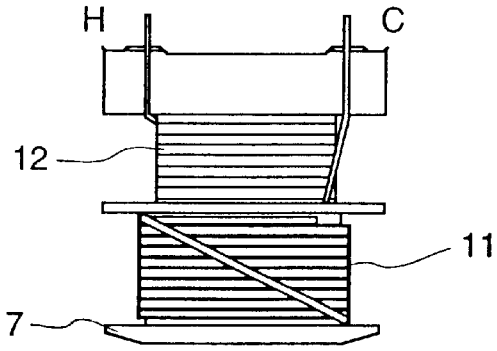
FIG. 2(*a*) is a side view of a bobbin in which a plurality of coils are wound for use in an embodiment of the present invention.
Figure 2B:
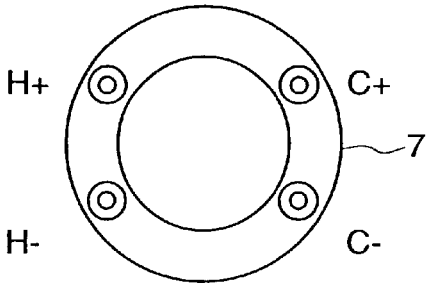
Figure 3:
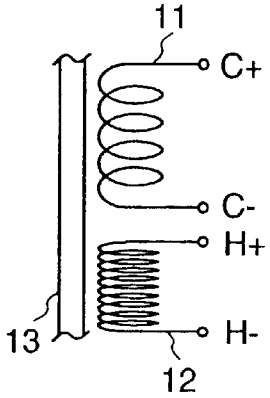
FIG. 3 is a schematic diagram of an equivalent circuit of the injector representing an embodiment of the present invention.

FIG. 1*a* is a side sectional view of an injector 10 representing an embodiment of the present invention, and FIG. 1*b* is a side view of a connector portion 6 of the injector 10, as seen from the left side of FIG. 1*a* (from a connector connection end side). FIG. 2*a* is a side view of coils wound on a bobbin provided inside the injector 10, and FIG. 2*b* is an end view of the bobbin of FIG. 2*a*, as seen from the upper side of FIG. 2*a* (an opposite side (upper side) relative to a fuel injection hole in the direction along the valve axis). FIG. 3 is a diagram showing an equivalent circuit of the drive coils of the injector 10.

First of all, referring to FIGS. 1*a* and 1*b*, the construction of the injector 10 of the present embodiment will be explained. The injector 10 of the present embodiment is supplied with fuel raised in pressure by a fuel pump, and a fuel passage is opened and closed between a ball valve of a valve body 16 and a seat surface (valve seat) 4 formed on the nozzle side of the injection to control the quantity of fuel injected from a fuel injection orifice 5 formed downstream of the valve seat 4. The ball valve of the valve body 16 is mounted on the tip of a plunger 15, and a swirler (fuel swirling element) 17 formed in a fuel passage 17*a*, which operates to impart a swirling force to the fuel, is arranged upstream of the valve seat 4. By the action of this swirler 17, atomization of the fuel injected from the fuel injection orifice 5 is promoted.

In order to drive the ball valve (valve body) 16, the injector 10 is provided with a control coil in the form of a first coil 11 and a hold coil in the form of a second coil 12. Passage of current through the coils 11, 12 generates a magnetic flux which passes through a magnetic path, consisting of a core 13, yoke 14 and the plunger 15, and generates an attracting force between the yoke 14 and the plunger 15. Thereby, the plunger 15 and ball valve 16 are displaced upward (in a direction separating the ball valve 16 from the valve seat 4), as seen in FIG. 1*a*, and fuel is injected from the fuel injection hole 5 through the fuel passage opened between the valve seat 4 and the ball valve 16. Further, the injector 10 is provided with a biasing member to press the plunger 15 and the ball valve 16 onto the valve seat 4 to close the valve when there is no attracting force by the control coil 11 and hold coil 12. In the present embodiment, a return spring 18 which is a spring member is provided as the biasing member.

As shown in FIGS. 1*a*, 1*b* and FIGS. 2*a*, 2*b*, the control coil 11 and hold coil 12 are wound on a bobbin 7. Both ends of the control coil 11 pass through the bobbin 7 and are led to a connector upper side through long terminals 33, 34 to become a C+ terminal and a C− terminal. Both ends of the hold coil 12 pass through the bobbin 7 and are led to a connector lower side to become a H+ terminal and a H− terminal. The winding direction and wiring of the two coils are determined so that a flux of the same orientation is generated in the control coil 11 and the hold coil 12 by applying a plus voltage to the H+ terminal and C+ terminal and connecting the H− and C− to a minus terminal of a battery.

As shown in FIG. 3, a driving means for driving the ball valve 16 of the injector 10 of the present embodiment can be shown by an equivalent circuit in which the control coil 11 and the hold coil 12 are wound on the core 13. Hereunder, an explanation of the wiring, current orientation, etc, will be presented using the equivalent circuit diagram of FIG. 3.

In the present embodiment, as mentioned above, two coils are provided. The control coil 11 is necessary to provide a maximum rise-characteristic of magnetomotive force, and in the case where it continues to generate magnetomotive force necessary to hold the valve open, it serves in an auxiliary role to the second coil. On the other hand, the hold coil 12 is sufficient to generate a magnetomotive force necessary to maintain the valve in an open condition singly or together with the control coil 11 when the valve open condition is secured to some extent by the control coil, and so it is unnecessary to consider a rapid rise characteristic with respect to the hold coil 12.

In the present embodiment, the control coil 11 and the hold coil 12 are constructed so as to have different characteristics from each other. The control coil 11 is small both in the number of turns (inductance) and in its electrical resistance. On the contrary, the hold coil 12 is large in the number of turns and in its electric resistance. In more detail, the control coil 11 requires a shorter length of wire material and is larger in cross-sectional area than the hold coil 12, whereby the electrical resistance is smaller.

The control coil 11 and hold coil 12 each have different roles from each other at each stage of the valve closing, valve opening, open valve holding and valve closing operations. The control coil 11 is used mainly at an initial stage of valve opening and is used as an auxiliary coil during the open valve holding condition in the present embodiment, while the hold coil 12 is intended to be mainly used for holding the valve open. Hereunder, the difference between the respective characteristics will be described.

Figure 4A:
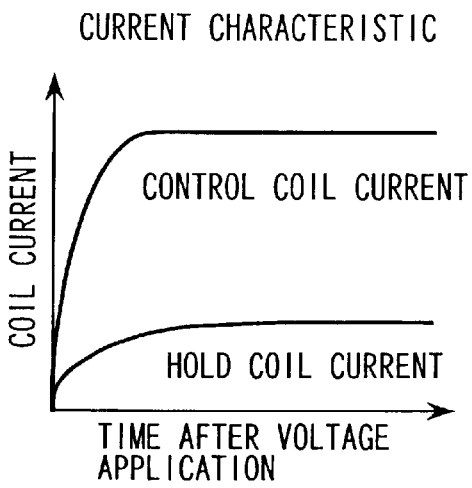
FIGS. 4A and 4B are diagrams showing characteristics of current and magnetomotive force response, respectively, for a control coil and a hold coil.
Figure 4B:
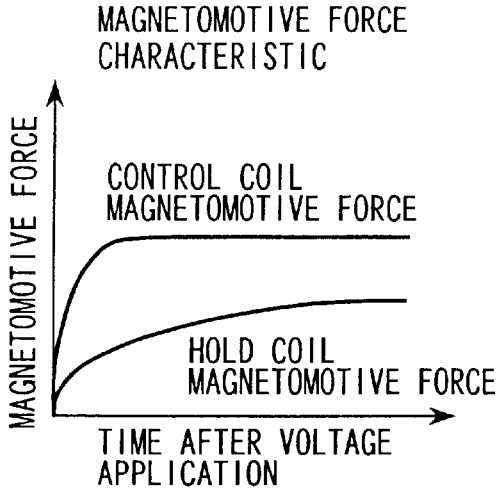

FIG. 4A shows the characteristics of the current flowing through the control valve 11 and hold valve 12 with the passage of time. Since the control coil 11 has a small number of turns and also has a small resistance, as mentioned above, the control coil 11 can reach a large current value in a short time. On the other hand, since the hold coil 12 has large number of turns and a large resistance also, a large time is required until the current converges on a value, and the convergent value also is smaller than that of the control coil. FIG. 4B shows the magnetomotive force response influencing the magnetic circuit of the injector 10. The magnetomotive force is expressed by a product of the number of turns and a current value, and considered as a physical quantity directly-connected to magnetic attraction. The current flowing through the control coil 11 rises rapidly, as shown in FIG. 4A, however, since the number of turns is small, the convergent value of magnetomotive force is not larger than the difference in the current, as compared with the hold coil 12. On the contrary, the magnetomotive force response of the hold coil 12 is duller than that of the control coil 11.

At the time of the valve opening operation, since a set load provided by the above-mentioned return spring 18 and the pressure of fuel is applied on the ball valve, a large electromagnetic attraction is required, compared with that needed for simply holding the valve open. At the time when the electromagnetic force reaches a magnitude over those forces, the plunger 15 starts to displace. Therefore, the rise time necessary for generation of the electromagnetic attraction affects the delay in valve opening, so that it is necessary to shorten this rise time as much as possible.

For example, it is more effective for the coil used for valve opening to produce an increase in the magnetomotive force by increasing the current, than it is to increase it by increasing the number of turns. Since the current passage time is limited to a short time until the valve is opened, excessive heat generation is unlikely to occur. The smaller the number of turns of coil, the smaller the inductance and internal resistance will be, so that the current will flow easily. That is, a coil characteristic such as used in a peak hold system is desirable. Further, the easiness of current flow is influenced by not only the coil inside the injector, but also by the internal resistance of the driving circuit, the resistance of the switching device and the voltage drop. Therefore, the internal resistance of the driving circuit, the resistance of the switching device and the voltage drop necessarily should be made extremely small.

On the other hand, in the open valve holding operation, the valve body can be held open with a smaller magnetomotive force than that required at the time of valve opening. This is because, as fuel is injected with the opening of the valve, the pressure balances between upstream and downstream sides of the ball valve 16 and the force due to the fuel pressure-becomes small; and, at the same time, air gaps of the core 13, case 14 and plunger 15 becomes small, so that the magnetic flux in the air gap increases and the magnetomotive force can be effectively used. However, when a high fuel pressure is required in order to promote a high injection ratio and increased atomization, a relatively large magnetomotive force is continuously needed also for holding the valve open.

When the condition during which the valve is held open continues, the temperature of the injector rises, because the power consumption (heat generation amount) is a product of the applied voltage and the current value, so that it also becomes necessary to increase the heat resistance capacity of the injector. For example, continuous application of voltage onto the coil as desirable for valve opening may result in input of excessive power. An upper limit of current for holding the valve open is within the range of heat resistance. Therefore, for the coil for holding the valve open, the required number of turns is obtained by dividing the required magnetomotive force by the upper limit of current. However, the inductance of a coil increases at the second power of the number of turns. Therefore, in order to shorten the response delay, an increase in the number of turns is restricted to some extent, and it is sufficient to establish a magnetomotive force for holding the valve open by using a current which is less than that used at the time of opening the valve.

Figure 5:
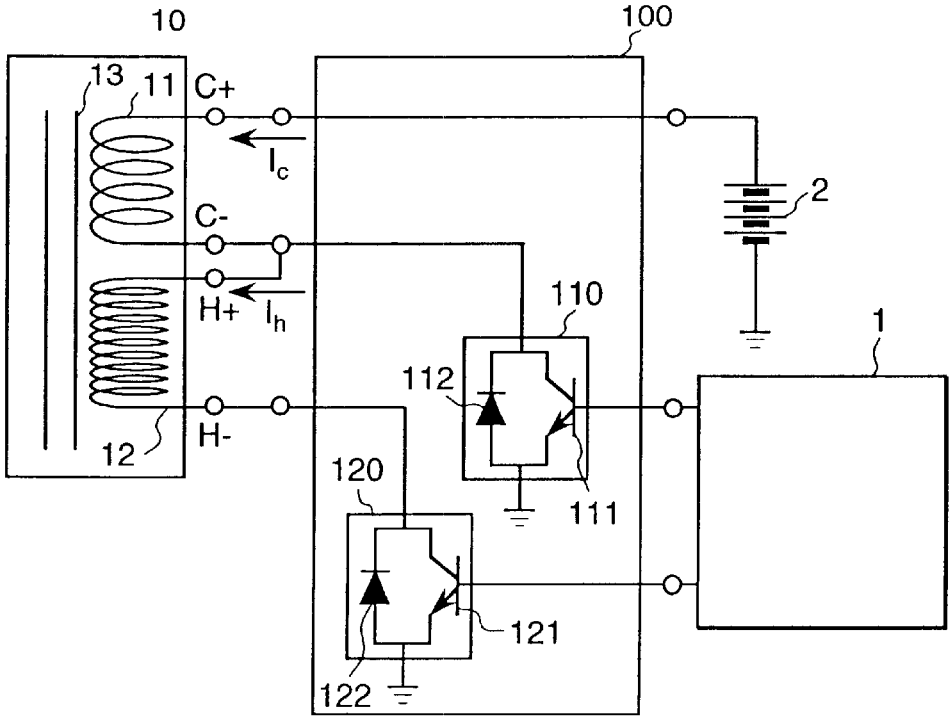
FIG. 5 is a schematic diagram of a circuit of the injector representing embodiment of the present invention.

FIG. 5 is a diagram of a drive circuit of the fuel injection apparatus of the present embodiment in which the above-mentioned driving conditions are possible. As mentioned above, large current is caused to flow mainly through the control coil 11 for a short time at the time of valve opening, and a current is caused to flow through the hold coil 12, and a current of the same quantity as that flowing in the hold coil 12 also is caused to flow through the control coil 11, at the time of holding the valve open.

By sharing the holding function between the control coil 11 and the hold coil 12, it is possible to optimize the number of turns of the coils, the coil resistance, the wire diameters, etc. for each function.

The fuel injection apparatus of the present embodiment comprises the injector 10 and a driving circuit 100 therefor. In some cases, a control circuit for controlling injection timing can be included. Further, usually, the control circuit is provided inside an engine controller (engine control unit: ECU) 1.

In the injector driving circuit 100, battery voltage Vb is supplied from a battery 2, and current is selectively supplied to the control coil 11 and hold coil 12 according to an injection instruction signal received from the engine controller 1. The injector driving circuit 100 has a control coil transistor module 110 for controlling the current supply to the control coil 11, and a hold coil transistor module 120 for controlling the current supply to the hold coil 12. Each transistor module 110, 120 is composed of a power transistor 111, 121 and a surge absorbed diode 112, 122.

A terminal at one end (C+) of the control coil 11 is connected to a plus terminal of the battery 2. The other end (C− terminal) of the control coil 11 and one end (H+ terminal) of the hold coil 12 are connected to each other and to a ground side of a power supply through the control coil transistor module 110. The other end (H− terminal) of the hold coil 12 is connected to the ground side of the power supply through the hold coil transistor module 120. Hereunder, current flowing through the control coil 11 will be referred to as Ic and current flowing into the hold coil 12 will be referred to as Ih.

Figure 6:
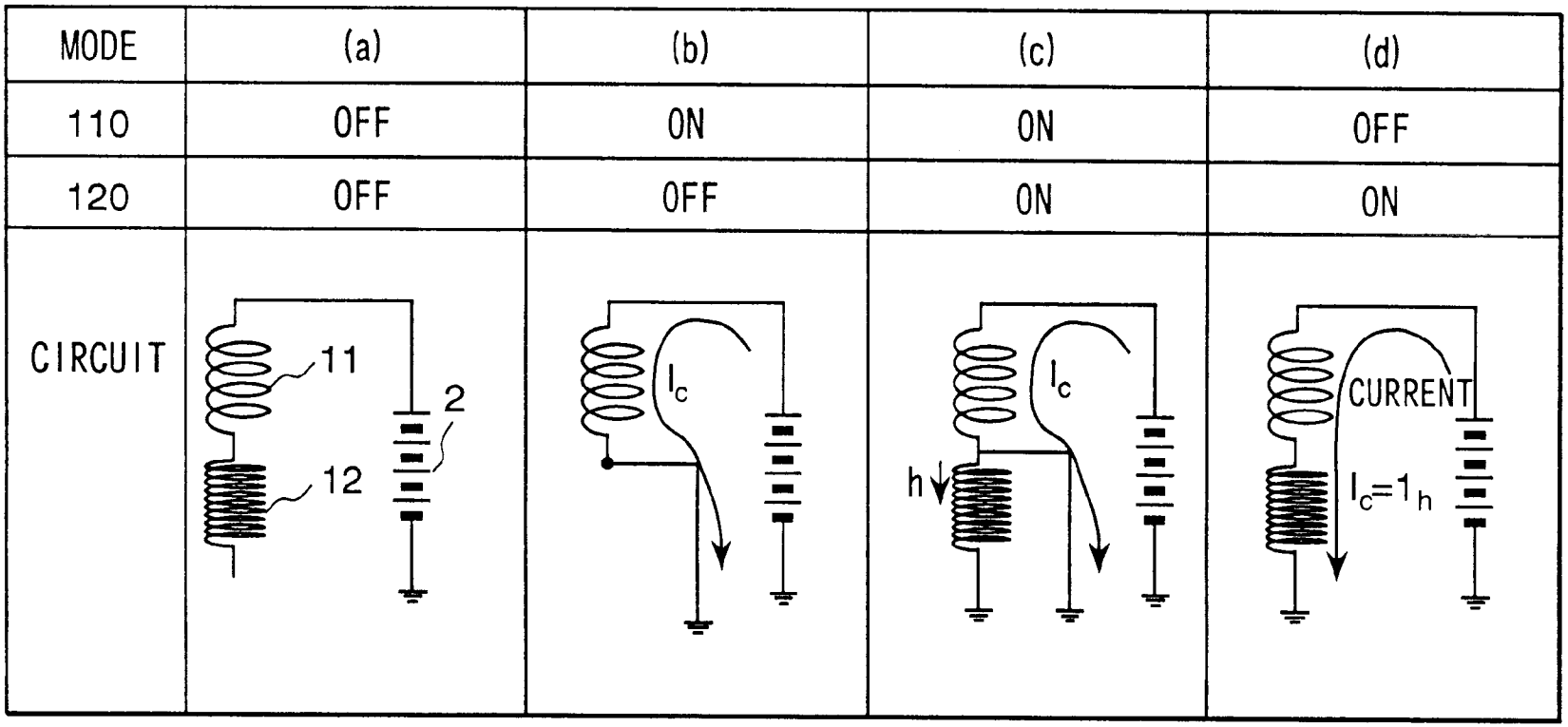
FIG. 6 is a table of diagrams showing driving modes in the embodiment of the present invention.

In FIG. 6, circuit constructions in respective modes and current flowing in respective coils when respective transistor modules are turned on-off are typically shown.

First, in the case of mode (a), both the control and hold coil transistor modules 110 and 120 are turned off. The control coil 11 and hold coil 12 are not connected to the ground side (minus side) of the power supply, and the circuit is open. Therefore, current does not flow in either the control coil 11 or hold coil 12 (Ic=Ih=0).

Next, in the case of mode (b), the control coil transistor module 110 is turned on and the hold coil transistor module 120 is turned off. As shown in FIG. 6, only the control coil 11 is connected to the ground side of the power supply to provide a closed circuit through the control coil 11. Since the control coil 11 has a low resistance and a small number of turns, as mentioned above, a large current flows in a short time, and the magnetomotive force rapidly increases so that driving of the ball valve 16 becomes possible.

Further, in the case of mode (c), both the control and hold coil transistor modules 110, 120 are turned on. In this case, the connecting portion of the control coil 11 and hold coil 12 is connected to ground, and, at the same time, the control coil 11 and the hold coil 12 are connected to each other to form a closed series. That is, the hold coil 12 and a line of very small resistance are connected in parallel. As mentioned above, the resistance of the hold coil 12 is relatively large, so that almost all of the current flowing in the control coil 11 is caused to flow through the control coil transistor module 110. Therefore, the circuit is different from the case of mode (b), but the effect of the application of magnetomotive force is considered to be nearly-equal to the case of mode (b).

At an initial stage of valve opening, either the mode (b) or the mode (c) is suitable, in which modes a rapid application of magnetomotive force is possible. Here, it is a continuous time to take care. Since in both modes (b) and (c) a large current flows, it is necessary to resist the current passage necessary for the modes to a short time.

Next, in the case of mode (d), the control coil 11 and hold coil 12 are connected to each other in series and form a closed circuit. Therefore, the same current flows in the control coil 11 and hold coil 12 (Ic=Ih). The current value is a value obtained by dividing the battery voltage by the sum of the resistance of the control coil 11 and hold coil 12. The number of turns and the resistance of the hold coil 12 each are larger than the number of turns and the resistance of the control coil 11, so that the current value is determined by almost only the resistance of the hold coil 12.

The mode (d) is suitable for the holding the valve open. Current flows in the hold coil 12, which has a relatively large number of turns, so as to produce an increased magnetomotive force; and, at the same time, current also flows in the control coil 11, which has a relatively small number of turns. It is possible to apply a large magnetomotive force in total, even compared with the case where current flows only in the hold coil 12.

As in the present embodiment, by constructing the driving circuit so that the control coil 11 and the hold coil 12 are connected in series so as to apply the voltage of the power supply only to the control coil 11 at an initial stage of valve opening and to apply the voltage of power supply to both the control coil 11 and the hold coil 12 at the time of holding the valve open, it is possible to dependably and effectively conduct the valve opening operation and the valve open holding operation with a simple driving circuit.

Figure 7:
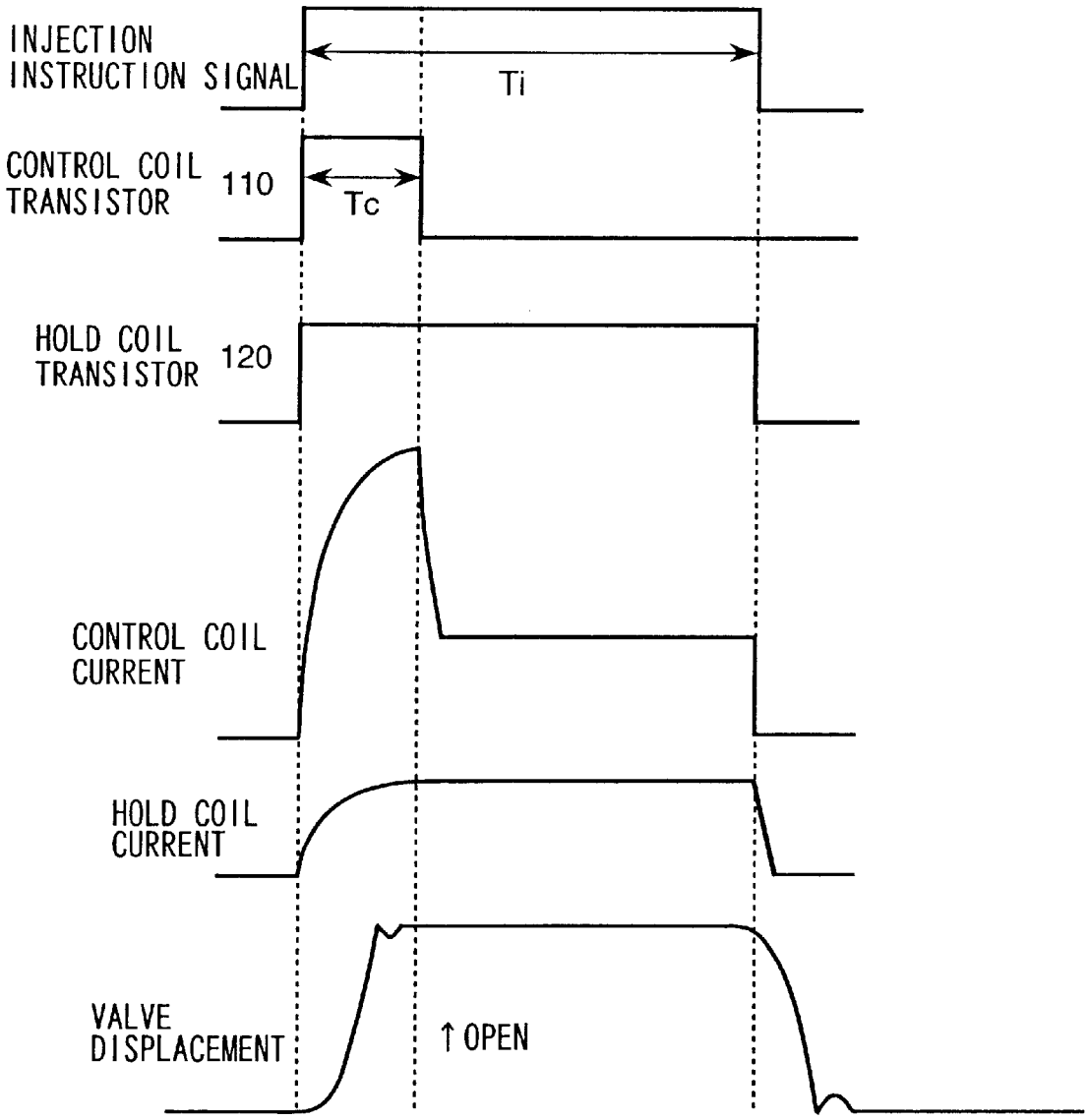
FIG. 7 is a timing diagram showing an injector driving method of a fuel injection apparatus according to an embodiment of the present invention.

FIG. 7 shows the timing of injector driving of the fuel injection apparatus of the present embodiment.

When an injection instruction signal of length Ti is issued, on the hold coil side, the hold coil transistor module 120 is turned on and maintained on during the full duration of the injection instruction signal (Ti), and the hold coil transistor module 120 is turned off at the same time as the injection instruction signal falls. On the other hand, only during an initial stage Tc(≦Ti) of valve opening will the control coil transistor module 110 be turned on. Therefore, the initial stage Tc(≦Ti) of valve opening becomes the mode (c) of FIG. 6. Therefore, a large current flows in the control coil 11 and a large magnetomotive force is applied for a short time to promote the valve opening. On the other hand, only the control coil transistor module 110 is turned off after the initial stage (Tc), that is, the operation turns to the mode (d) of FIG. 6, and current flows both in the control coil transistor module 110 and in the hold coil transistor module 120, whereby a large magnetomotive force is applied and it is possible to stably hold the valve open even under a condition of high fuel pressure, as compared with the case where current flows only in the hold coil 12.

When time T, from the time when the injection instruction signal is issued, reaches Ti, that is, when T=Ti, the injection pulse falls; and, at the same time, the hold coil transistor module 120 is turned off, so that the operation turns to the mode (a) of FIG. 6. The circuit is opened, current to the control coil 11 and hold coil 12 is interrupted, and the valve body starts rapidly to close the valve.

Figure 8C:
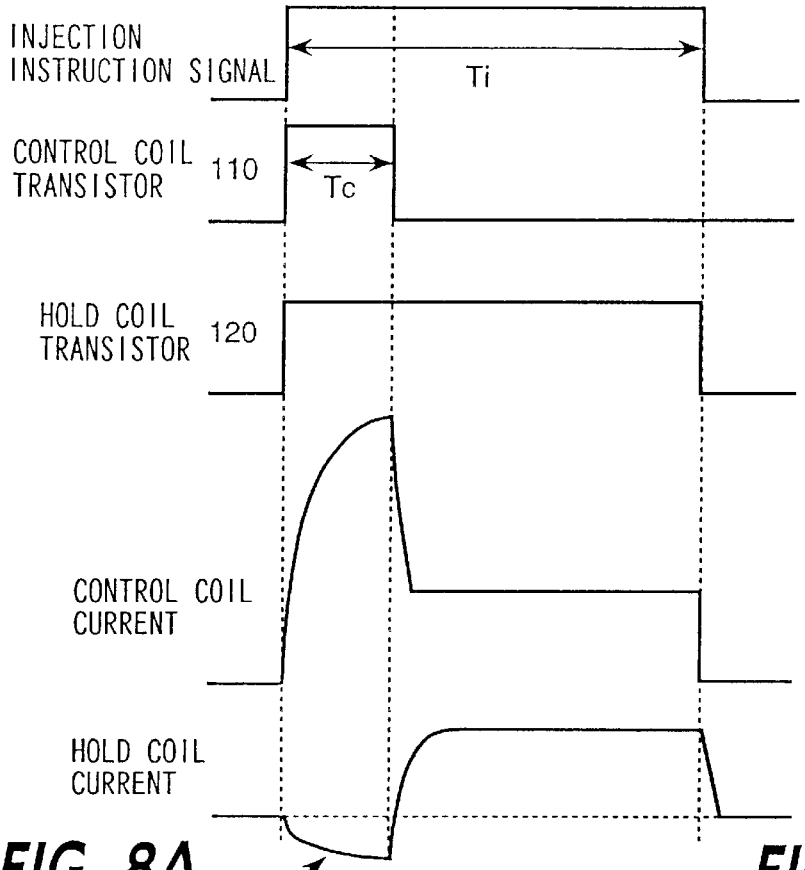
FIG. 8C is a timing diagram related to the operation thereof.
Figure 8A:
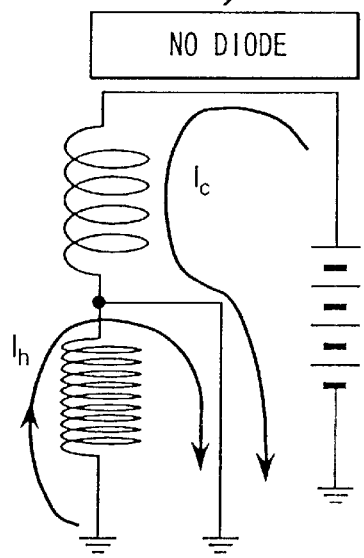
FIG. 8A is a schematic circuit diagram of an injector driving circuit in which no diode is provided.

FIGS. 8A to 8D illustrate a mutual induction phenomenon which occur in the case where mutual inductance is generated between the control coil 11 and the hold coil 12, and is directed to an improvement according to the present invention. When the transistor modules are turned on or off in the manner described with reference to FIG. 7, a magnetomotive force in a reverse direction is generated in the hold coil 12, when a large current in the control coil 11 rises during the period Tc(≦Ti). This is called mutual inductance, and it is equivalent to the magnetic phenomenon which occurs in a transformer or the like. When such a magnetomotive force occurs, current flows in a reverse direction, as seen in FIG. 8C, from the ground side of the power supply through a surge absorbed diode 122 (FIG. 5) of hold coil transistor module 120. This current flows in the hold coil 12, as seen in FIG. 8A, in a direction from the terminal H− to the terminal H+ (in a reverse direction to the direction when a voltage is applied), and serves to weaken the magnetic flux generated in a magnetic circuit. The current flows into the power supply ground through the control coil transistor module 110. If the reverse current is allowed to flow during the period Tc(<Ti), the substantial magnetomotive force to be applied when the valve is opened decrease, and there is the possibility that a delay in opening of the valve will occur and that the valve body will not be surely held.

Figure 8B:
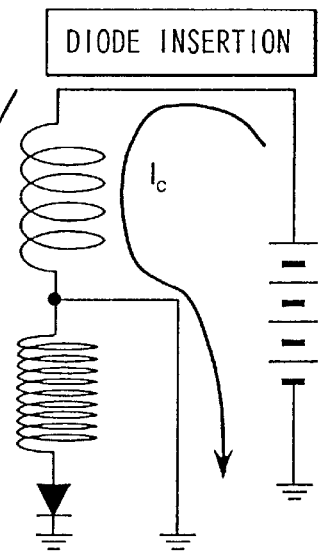
FIG. 8B is a schematic circuit diagram of an injector driving circuit in which a diode is inserted, according to the present invention.
Figure 8D:
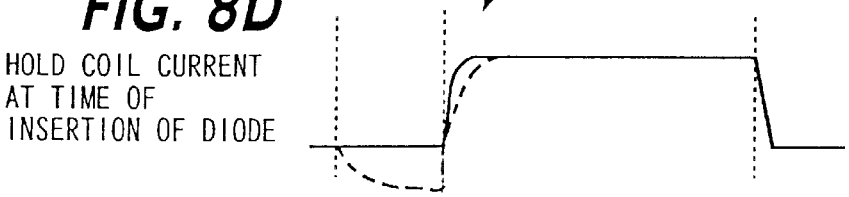
FIG. 8D is a timing diagram related to the operation thereof.

In order to avoid this problem, it is sufficient to insert a diode in series with the hold coil 12, as seen in FIG. 8B, which enables current passage only in a normal direction, as shown in FIG. 8D. When no reverse current flows in the hold coil 12, a normal-direction current-rise characteristic can be obtained. As shown in FIG. 8B, the diode may be provided between the hold coil 12 and the minus side of the power supply. More specifically, the diode may be provided between the hold coil 12 and the hold coil transistor module 120, or between the hold coil transistor module 120 and the minus side of the power supply.

Further, when the reverse current is not completely interrupted and the value thereof is desired to be adjusted, a resistance may be inserted in parallel with the diode, and the resistance will be sufficient to adjust the quantity of the reverse current.

Figure 9:
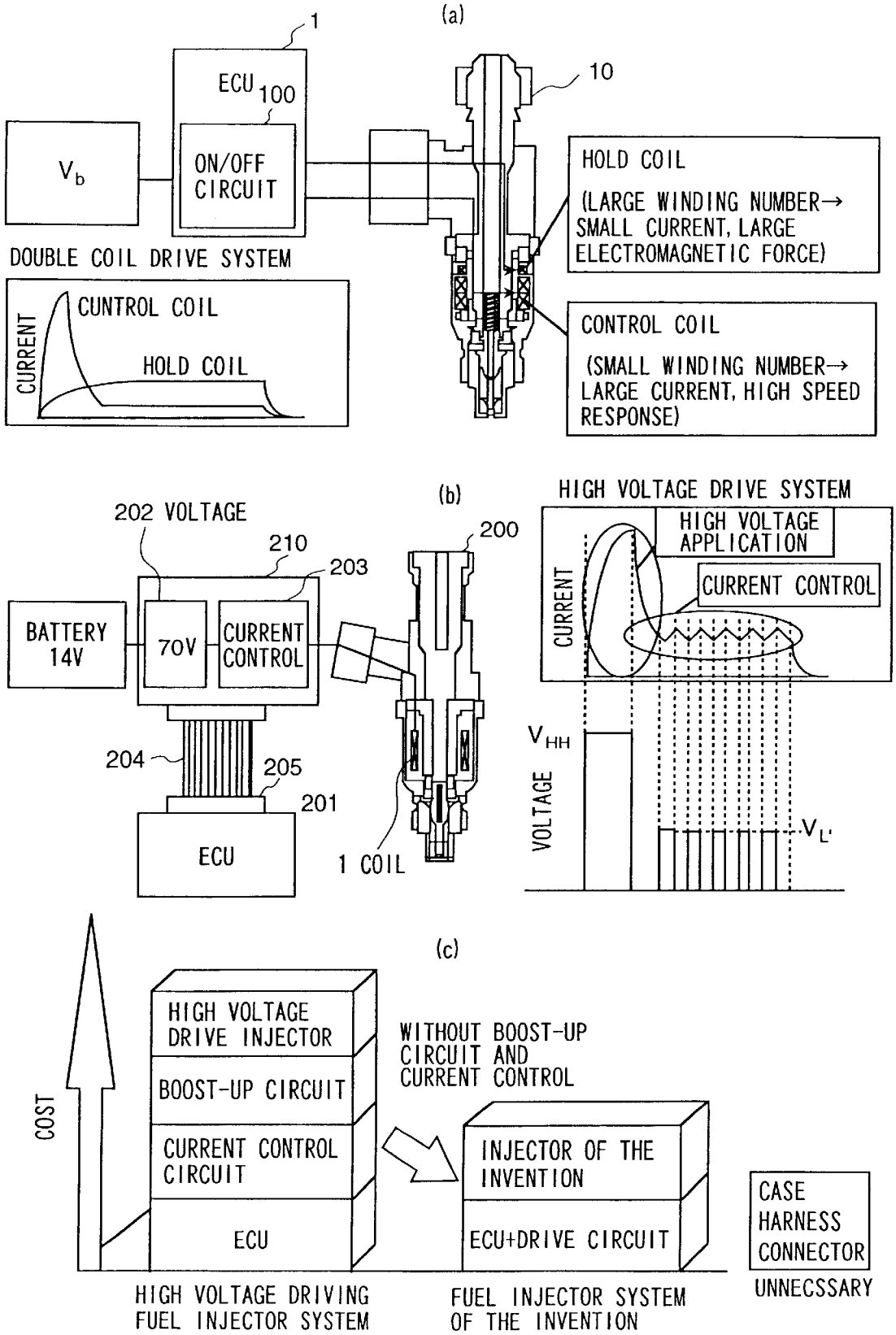
FIGS. 9(*a*) to 9(*c*) are diagrams showing a comparison of the construction, cost and size between a conventional high voltage driving fuel injection apparatus and a fuel injection apparatus of the present invention.

As shown in FIG. 9(*a*), in the present embodiment, the control coil 11 is made to have a small number of turns, so that a large current can flow in a short time and high speed response is possible, while the hold coil 12 is made to have a characteristic such that a stable attraction can be obtained with a small current. Current is caused to flow mainly in the control coil 11 at the initial stage of valve opening, and then the control coil 11 and the hold coil 12 are connected in series and the same current flows therein during the time the valve is held open. At each stage of the valve opening and the open valve holding operation, an optimum operation in which a stable valve holding can be realized even under a condition of high fuel pressure is made possible by combining an ideal coil characteristic and ideal current passage method.

On the other hand, as seed in FIG. 9(*b*), operation of a conventional high voltage driving fuel injection apparatus is shown. In the high voltage injector, it is necessary to open the valve and to hold the valve open using a single coil, so that it is difficult to obtain an ideal coil characteristic at each stage. For example, when the number of turns and the resistance of the coil are made small in the same manner as in the control coil 11 of the present embodiment in order to improve the response at the time of valve opening, it is necessary to cause a large current to flow continuously at time the valve is being held open, so that the amount of heat being generated becomes large. On the contrary, when the number of turns and resistance of the coil are made to be the same as the hold coil 12 of the present embodiment, the valve can not be opened or the delay in opening the valve becomes very large. Therefore, a single coil can not be designed which offers a compromise for both the required valve opening characteristic and required valve holding characteristic.

The high voltage driving injector generates a very high voltage VHH(>>VH) from the battery by using a boost circuit 202, and applies this very high voltage to the coil to cause the current to rise rapidly to open the valve. Since to much current will flow when the battery voltage VL' (<<VHH) is directly applied to the coil after the valve has opened, the current is controlled, so that it is reduced until it becomes constant at the lowest value which still enables the valve to be held open, by switching in a current control circuit 203. The scale of the boost circuit 202 and the current control circuit 203 is large, so that it is difficult to arrange them inside a conventional engine control unit. Therefore, in the high voltage driving fuel injection apparatus, an injector driving circuit 210 is arranged separately from the engine controller (ECU) 201. By arranging them separately, the injector driving circuit 210 needs its own case. Further, a harness 204 and connector 205 become necessary for transmission of signals from the engine controller 201 to the injector driving circuit 210. Further, it becomes necessary to use a high cost shield line in order to prevent the transfer of switching noises, at time of driving the current control circuit, to the engine controller 201, a radio, etc.

Here, as shown in FIG. 5 also, the scale of the driving circuit of the fuel injection apparatus of the present embodiment is, basically, an on/off circuit composed of two power transistors, so that it is very low in cost and compact in construction. Further, since a switching operation is unnecessary, noises do not occur, either. Therefore, the injector driving circuit 100 can be contained inside the engine controller (engine control unit: ECU).

FIG. 9(*c*) shows a comparison of the cost and size between the conventional high voltage fuel injection apparatus and the fuel injection apparatus of the present embodiment. It is possible to abolish the boost circuit and the current control circuit and it is possible to reduce the scale of the circuit, so that a separate case, harness, connector, etc. become unnecessary and it is possible to effect a large cost reduction and miniaturization.

Figure 10:
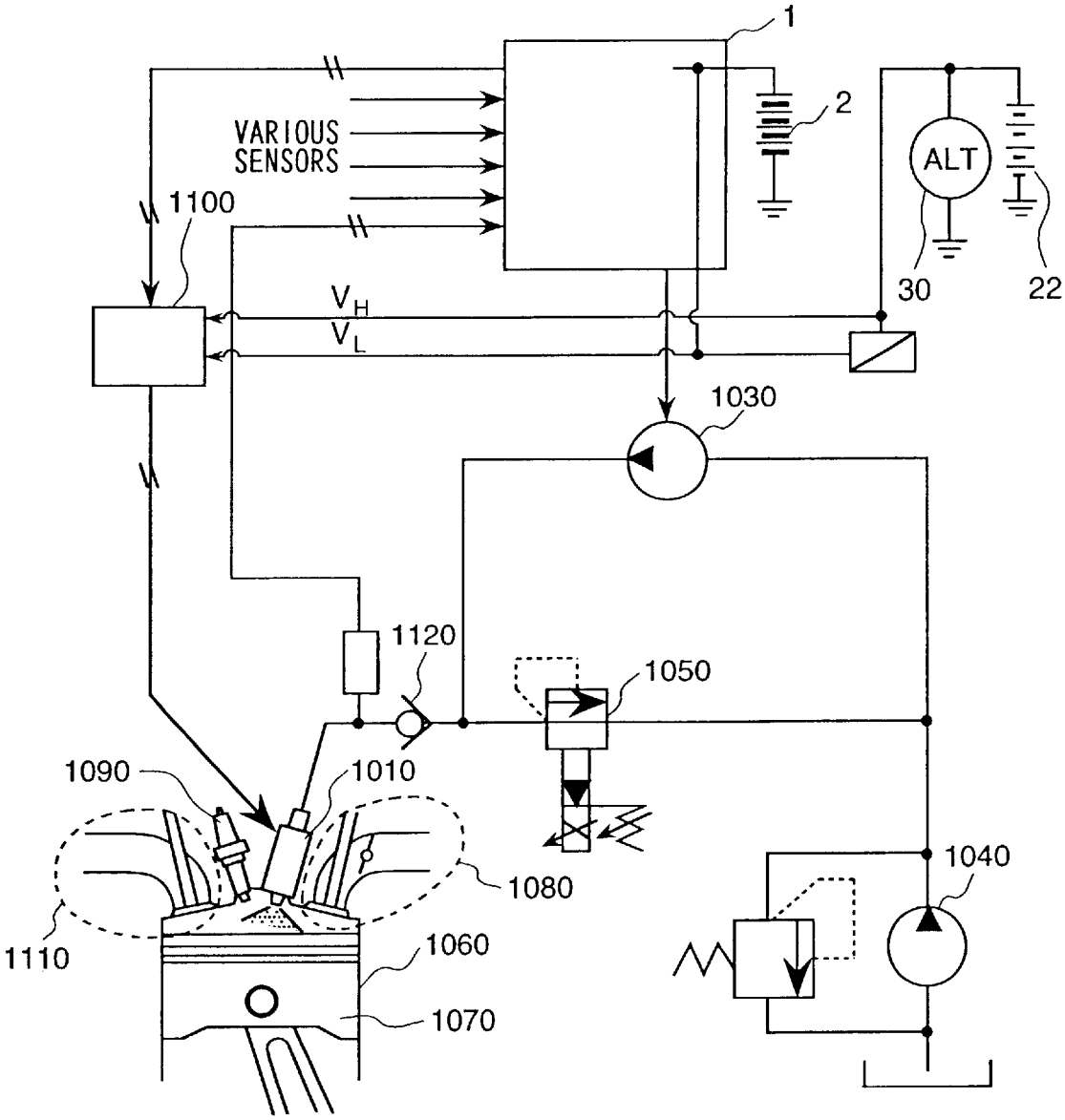
FIG. 10 is a schematic diagram of an embodiment of an internal combustion engine to which the present invention is applied.

An embodiment of an internal combustion engine to which the fuel injection apparatus of the present invention is applied will be explained with reference to FIG. 10. The internal combustion engine comprises a fuel injection apparatus (an electromagnetic fuel injector 1010 and a driving circuit 1100) for injecting fuel, a fuel supply means (a fuel pump 1030, a feed pump 1040 and a high pressure regulator 1050) for supplying the fuel injection apparatus with fuel, a cylinder 1060 in which fuel injected by the fuel injection apparatus is burned, a piston 1070 reciprocating inside the cylinder, an intake means 1080 for supplying air into the cylinder 1060, an ignition device 1090 for igniting the air-fuel mixture inside the cylinder 1060, an exhaust means 1110 for exhausting gas from the inside of the cylinder 1060, and an engine control unit 1 for controlling the intake means (an intake pipe, valve, etc.) 1080, the exhaust means (an exhaust pipe, valve, etc.) 1110, the ignition device 1090 and the fuel ignition apparatus. Further, a battery voltage Vb from the battery 2 is applied to the driving circuit 1100.

In this internal combustion engine, fuel is supplied to the fuel pump 1030 by the feed pump 1040, from which it is supplied to the injector 1010 with increased pressure through a check valve 1120. The engine controller 1 determines the injection timing and injection quantity, from data supplied by various sensors, and outputs an injection signal to the injector driving circuit 1100. The injector 1010 is driven by the driving circuit 1100 to inject fuel. The present embodiment has been explained with reference to a direct fuel injection type engine (fuel is directly injected inside the cylinder), however, it is a matter of course that it can be applied to other kinds of engine.

According to the present embodiment, an ideal coil characteristic and an ideal current passage method are combined at each stage of the valve opening operation and the valve open holding operation, so that a stable holding can be realized even in the case of a high fuel pressure, and optimum operation of the injector is possible.

In the period from the closed condition of the valve until the valve in closed condition is opened, kept open and then again closed, an ideal coil characteristic and an ideal current passage method for each condition are combined, so that a stable valve open holding can be realized even with a high fuel pressure and optimum driving of the valve is effected, whereby a fuel injection apparatus in which a wide dynamic range is realized can be provided at a low cost.

The injector and its driving circuit have been explained. As the injector and its driving circuit system, a saturated type (voltage driving) and peak hold type are known well.

Generally, the saturated system has a large number of turns, so that the driving current continues to increase even after the lifting of the valve is completed unit it approaches a saturated current value limited by the coil resistance and resistance inside the driving circuit. The circuit impedance is higher than that of the peak hold system, and the rise time of current flowing in the coil is slow due to the influence of the inductance. By setting a proper saturated current value by adjusting the internal coil resistance and the resistance inside the driving circuit, a driving circuit is easily constructed without the necessity of a current control circuit.

On the other hand, the peak hold system has a small number of coil turns, and the circuit inductance and impedance each are low, so that the current rise at the time of valve opening is faster than in the saturated system. However, there is possibility that an over current may flow, as it is, so that a flow control mechanism is provided inside the driving circuit, whereby the current is limited to a value necessary for holding the valve open after full lifting of the ball valve.

In order to achieve a high injection ratio which will become a performance standard for an injector and provide a wide dynamic range, in many cases the peak hold system which has a high current response is employed. Further, it is possible to improve the rise characteristic in valve opening by supplying high voltage through use of a boost circuit and applying the high voltage to the injector thereby to cause current to forcibly flow for a short time. Further, when the valve is closed, the valve closing characteristic can be improved by reversely applying this high voltage.

According to the present invention, it is possible to realize a fuel injection apparatus which will stably operate in a wide dynamic range by providing a plurality of coils having different electrical characteristics, combining an ideal coil characteristic and an ideal current passage method and optimally driving the valve body in a way which provides stable valve holding even under high fuel pressure conditions.

What is claimed is:

1. A fuel injection apparatus comprising an electromagnetic fuel injection valve and a driving circuit driving said electromagnetic fuel injection valve, wherein said electromagnetic fuel injection valve is provided with a first coil having a large rate of change in time of magnetomotive force and a second coil having a smaller rate of change in time of magnetomotive force than said first coil, and wherein one end of said first coil is connected to a plus side of a power supply of said driving circuit, the other end of said first coil is connected to one end of said second coil and to a minus side of said power supply via a first switching circuit controlling current passage, the other end of said second coil is connected to the minus side of the power supply of said driving circuit via a second switching circuit provided with a surge absorbed diode and controlling current passage, and said first and second coils are arranged so that magnetomotive force in a reverse direction due to mutual inductance could be generated in said second coil when current in said first coil rises, whereby at an initial stage of opening operation of said valve, at least said first switching circuit is turned on to cause a first current to flow into at least said first coil, after which only said second switching circuit is turned on, thereby causing a second current to flow into both said first and second coils, said driving circuit including a diode that allows current to flow only in a direction from said second coil to said second switching circuit, said diode provided between said second coil and said second switching circuit or between said second switching circuit and the minus side of the power supply so as to substantially prevent said magnetomotive force in a reverse direction.

2. The fuel injection apparatus of claim 1, wherein said second current has a value obtained by dividing the power supply voltage by the sum of the resistance of the first and second coils, and wherein the resistance of the second coil is greater than the resistance of the first coil so that said value of said second current is determined primarily by the resistance of the second coil.

3. A fuel injection apparatus comprising an electromagnetic fuel injection valve and a driving circuit driving said electromagnetic fuel injection valve, wherein said electromagnetic fuel injection valve is provided with a first coil having a small turn number and a second coil having a larger turn number than said first coil, wherein one end of said first coil is connected to a plus side of a power supply of said driving circuit, the other end of said first coil is connected to one end of said second coil and to a minus side of said power supply via a first switching circuit controlling current passage, the other end of said second coil is connected to the minus side of the power supply of said driving circuit via a second switching circuit provided with a surge absorbed diode and controlling current passage, and said first and second coils are arranged so that magnetomotive force in a reverse direction due to mutual inductance could be generated in said second coil when current in said first coil rises, whereby at an initial stage of opening operation of said valve, at least said first switching circuit is turned on to cause a first current to flow into at least said first coil, after which only said second switching circuit is turned on, thereby causing a second current to flow into both said first and second coils, said driving circuit including a diode that allows current to flow only in a direction from said second coil to said second switching circuit, said diode provided between said second coil and said second switching circuit or between said second switching circuit and the minus side of the power supply so as to substantially prevent said magnetomotive force in a reverse direction.

4. The fuel injection apparatus of claim 3, wherein said second current has a value obtained by dividing the power supply voltage by the sum of the resistance of the first and second coils, and wherein the resistance of the second coil is greater than the resistance of the first coil so that said value of said second current is determined primarily by the resistance of the second coil.

5. A fuel injection apparatus comprising an electromagnetic fuel injection valve and a driving circuit driving said electromagnetic fuel injection valve, wherein said electromagnetic fuel injection valve is provided with a first coil having a wire of large cross-sectional area and a second coil having a wire with a smaller cross-sectional area than that of said first coil, wherein one end of said first coil is connected to a plus side of a power supply of said driving circuit, the other end of said first coil is connected to one end of said second coil and to a minus side of said power supply via a first switching circuit controlling current passage, the other end of said second coil is connected to the minus side of the power supply of said driving circuit via a second switching circuit provided with a surge absorbed diode and controlling current passage, and said first and second coils are arranged so that magnetomotive force in a reverse direction due to mutual inductance could be generated in said second coil when current in said first coil rises, whereby at an initial stage of opening operation of said valve, at least said first switching circuit is turned on to cause a first current to flow into at least said first coil, after which only said second switching circuit is turned on, thereby causing a second current to flow into both said first and second coils, said driving circuit including a diode that allows current to flow only in a direction from said second coil to said second switching circuit, said diode provided between said second coil and said second switching circuit or between said second switching circuit and the minus side of the power supply so as to substantially prevent said magnetomotive force in a reverse direction.

6. The fuel injection apparatus of claim 5, wherein said second current has a value obtained by dividing the power supply voltage by the sum of the resistance of the first and second coils, and wherein the resistance of the second coil is greater than the resistance of the first coil so that said value of said second current is determined primarily by the resistance of the second coil.

7. A fuel injection apparatus comprising an electromagnetic fuel injection valve and a driving circuit driving said electromagnetic fuel injection valve, wherein said electromagnetic fuel injection valve is provided with a first coil having a small electrical resistance between terminals and a second coil having a larger electrical resistance between terminals than said first coil, wherein one end of said first coil is connected to a plus side of a power supply of said driving circuit, the other end of said first coil is connected to one end of said second coil and to a minus side of said power supply via a first switching circuit controlling current passage, the other end of said second coil is connected to the minus side of the power supply of said driving circuit via a second switching circuit provided with a surge absorbed diode and controlling current passage, and said first and second coils are arranged so that magnetomotive force in a reverse direction due to mutual inductance could be generated in said second coil when current in said first coil rises, whereby at an initial stage of opening operation of said valve, at least said first switching circuit is turned on to cause a first current to flow into at least said first coil, after which only said second switching circuit is turned on, thereby causing a second current to flow into both said first and second coils, wherein said second current has a value obtained by dividing the power supply voltage by the sum of the resistance of the first and second coils, said driving circuit including a diode that allows current to flow only in a direction from said second coil to said second switching circuit, said diode provided between said second coil and said second switching circuit or between said second switching circuit and the minus side of the power supply so as to substantially prevent said magnetomotive force in a reverse direction.

8. The fuel injection apparatus of claim 7, wherein said second current has a value obtained by dividing the power supply voltage by the sum of the resistance of the first and second coils, and wherein the resistance of the second coil is greater than the resistance of the first coil so that said value of said second current is determined primarily by the resistance of the second coil.

9. A fuel injection apparatus according to any one of claims 1 to 7, wherein said first and second switching circuits each include a transistor provided with a surge absorbed diode.

10. An internal combustion engine comprising a fuel injection apparatus for injecting fuel, a fuel supply system for supplying fuel into said fuel injection apparatus, a cylinder for burning therein fuel injected by said fuel injection apparatus, a piston reciprocating in said cylinder, an intake system for supplying air into said cylinder, an ignition device for igniting a fuel-air mixture inside said cylinder, an exhaust system for exhausting gas from the inside of said cylinder, and an engine control unit for controlling said intake system, said exhaust system, said ignition device and said fuel injection device, said fuel injection apparatus being provided with an electromagnetic fuel injection valve and a driving circuit driving said electromagnetic fuel injection valve, and said electromagnetic fuel injection valve being provided with a fuel injection hole, a valve seat on an upstream side of said fuel injection hole, a valve body for effecting valve opening of a fuel passage between said valve body and said valve seat, and a coil for generating a driving force for displacing said valve body, wherein said magnetic fuel injection valve is provided with a first coil having a large rate of change in time of magnetomotive force and a second coil having a smaller rate of change in time of magnetomotive force than said first coil, one end of said first coil is connected to a plus side of a power supply of said driving circuit, the other end of said first coil is connected to one end of said second coil and to a minus side of said power supply using a first switching circuit controlling current passage, the other end of said second coil is connected to the minus side of the power supply of said driving circuit using a second switching circuit provided with a surge absorbed diode and controlling current passage, and said first and second coils are arranged so that magnetomotive force in a reverse direction due to mutual inductance could be generated in said second coil when current in said first coil rises, whereby at an initial stage of opening operation of said valve, at least said first switching circuit is on to cause a first current to flow into at least said first coil, after which only said second switching circuit is turned on, thereby causing a second current to flow into both said first and second coils, said driving circuit including a diode that allows current to flow only in a direction from said second coil to said second switching circuit, said diode provided between said second coil and said second switching circuit or between said second switching circuit and the minus side of the power supply so as to substantially prevent said magnetomotive force in a reverse direction.

11. An internal combustion engine according to claim 10 wherein the electromagnetic fuel injection valve includes a plunger coupled to said valve body for moving the valve body into opened and closed positions with said valve seat in response to current flowing in said first coil, and wherein said first coil is located closer to said plunger than said second coil.

12. The fuel injection apparatus of claim 10, wherein said second current has a value obtained by dividing the power supply voltage by the sum of the resistance of the first and second coils, and wherein the resistance of the second coil is greater than the resistance of the first coil so that said value of said second current is determined primarily by the resistance of the second coil.

* * * * *